US007722309B2

(12) United States Patent
Yuan

(10) Patent No.: US 7,722,309 B2
(45) Date of Patent: May 25, 2010

(54) APPARATUS FOR PICKING AND PLACING WORKPIECE

(75) Inventor: Kun-I Yuan, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 535 days.

(21) Appl. No.: 11/608,643

(22) Filed: Dec. 8, 2006

(65) Prior Publication Data

US 2008/0066514 A1 Mar. 20, 2008

(30) Foreign Application Priority Data

Sep. 15, 2006 (CN) ..... 2006 1 0062675

(51) Int. Cl.
*B65G 1/133* (2006.01)

(52) U.S. Cl. ..... 414/752.1; 294/64.1; 901/40

(58) Field of Classification Search ..... 414/752.1, 414/737; 294/64.1; 901/40; 15/302; 269/21
See application file for complete search history.

(56) References Cited

U.S. PATENT DOCUMENTS 3,174,789 A * 3/1965 Scherr ..... 294/64.1
4,189,137 A 2/1980 Denney et al.
4,703,965 A * 11/1987 Lee et al. ..... 294/64.1
5,067,763 A * 11/1991 Aoyama ..... 294/65.5
5,261,265 A * 11/1993 Nichols ..... 72/420
6,244,640 B1 6/2001 Le Bricquer et al.
6,287,071 B1 * 9/2001 Hsieh et al. ..... 414/627
6,701,610 B1 3/2004 Van De Vall et al.
2003/0115747 A1 * 6/2003 Schnetzler et al. ..... 29/830
2005/0246890 A1 * 11/2005 Isogai et al. ..... 29/740
2009/0290967 A1 * 11/2009 Jamieson et al. ..... 414/752.1

FOREIGN PATENT DOCUMENTS

CN 1713013 A 12/2005

* cited by examiner

*Primary Examiner*—Saúl J Rodriguez
*Assistant Examiner*—Joshua I Rudawitz
(74) *Attorney, Agent, or Firm*—Jeffrey T. Knapp

(57) ABSTRACT

An exemplary apparatus capable of picking and placing a workpiece into a container includes a suction device and a hollow body. The suction device is configured for providing a suction force for picking up the workpiece. The hollow body has a picking portion configured for picking and placing the workpiece into the container under the suction force, wherein a plurality of air slots are defined in an outer wall of the hollow body, the air slots are configured for providing an air passage between an interior of the container and an exterior thereof so as to facilitate movement of the hollow body into and out of the container, whereby the workpiece can be steadily placed in the container.

13 Claims, 8 Drawing Sheets

APPARATUS FOR PICKING AND PLACING WORKPIECE

TECHNICAL FIELD

The present invention generally relates to apparatuses for picking and placing workpieces, and more particularly, to an apparatus for picking and placing a workpiece under suction force.

BACKGROUND

In the assembling of a product or a semi-finished product, apparatuses for picking and placing workpieces of such products are widely used. A typical such apparatus includes a suction device and at least one hollow body coupled to the suction device. The hollow body may pick a workpiece at an end thereof under a suction force provided by the suction device, and then place the workpiece into a container. Generally, an internal breadth of the hollow body is slightly smaller than an external breadth of the workpiece, thus allowing the workpiece to be picked precisely and steadily.

However, when the workpiece is, for example, a lens module, and the container is, for example, a barrel, the internal breadth (diameter) of the hollow body is closely approximate to the external breadth of the workpiece, and an external breadth of the hollow body is closely approximate to an internal breadth of the barrel. As a result, air inside the barrel may be compressed thereby increasing an atmospheric pressure inside the barrel during the workpiece being moved into the barrel, such that pressure imbalance is generated between the exterior of the barrel and the interior of the barrel. This makes it difficult to orient the workpiece precisely. In addition, when the hollow body moves out of the barrel after placing the workpiece, atmospheric pressure inside the barrel may immediately decrease, whereby pressure imbalance is generated between the interior of the barrel and the exterior of the barrel. As a result, it is difficult to move the hollow body out of the barrel.

What is needed, therefore, is a device capable of picking and placing a workpiece into a container, which overcomes the above-mentioned problems.

SUMMARY

In a preferred embodiment, an exemplary apparatus capable of picking and placing a workpiece into a container includes a suction device and a hollow body. The suction device provides a suction force for picking up the workpiece. The hollow body has a picking portion for picking and placing the workpiece into the container under the suction force, wherein a plurality of air slots are defined in an outer wall of the hollow body, the air slots are configured for providing an air passage between an interior of the container and an exterior thereof so as to facilitate movement of the hollow body into and out of the container, whereby the workpiece can be steadily placed in the container.

Other objects, advantages and novel features of the invention will become more apparent from the following detailed description when taken in conjunction with the accompanying drawings.

BRIEF DESCRIPTION OF THE DRAWINGS

Many aspects of the apparatus can be better understood with reference to the following drawings. The components in the drawing are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE PREFERRED EMBODIMENTS

Embodiments of the present apparatus will now be described in detail below and with reference to the drawings.

Figure 1:
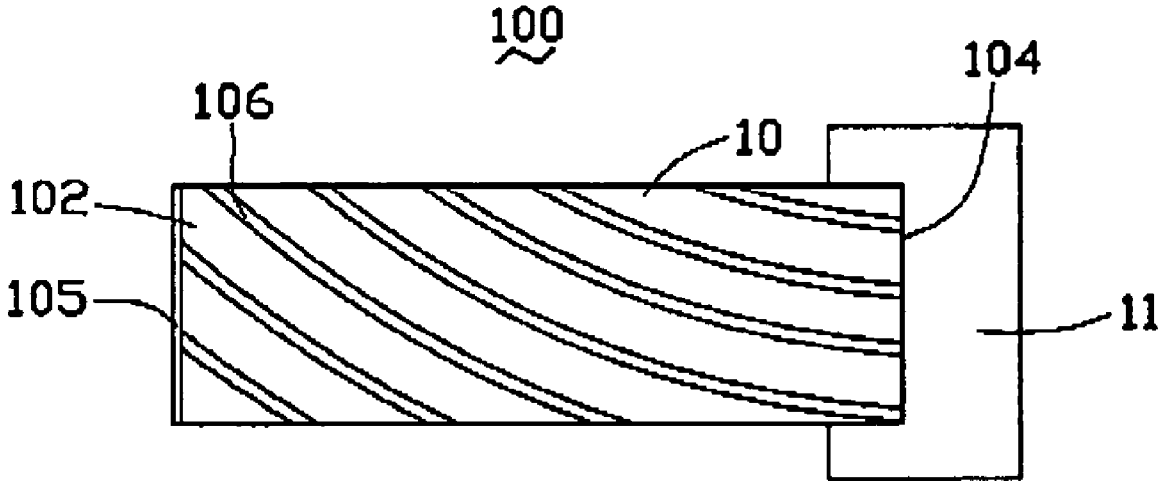
FIG. 1 is a schematic view of an apparatus capable of picking and placing a workpiece into a container according to a preferred embodiment.

Referring to FIG. 1, an exemplary apparatus 100 according to a preferred embodiment includes an elongated hollow body 10 and a suction device 11, the suction device 11 is configured for providing a suction force to the hollow body 10.

The hollow body 10 may have an exterior shape conforming to an interior shape of a container which is configured for containing a workpiece. For example, the hollow body 10 can be an isometric cylinder (see FIG. 1), a cylinder having a reducer (see FIG. 2), or a cylinder having a distortion (see FIG. 3). An internal breadth of the hollow body 10 can be equal to or slightly smaller than an external breadth of the workpiece, and an external breadth of the hollow body 10 can be approximately equal to an internal breadth of the container. The hollow body 10 defines a first end 102, a second end 104 opposite to the first end 102, and a number of air slots 106. The first end 102 can be used as a picking portion configured for picking and placing the workpiece into the container. Preferably, a rubber ring 105 is mounted on the first end 102, and the rubber ring 105 can help to contact the workpiece tightly. The second end 104 is configured for coupling to the suction device 11. The air slots 106 are defined in an outer wall of the hollow body 10 away from an inner wall of the hollow body 10. In one embodiment, the air slots 106 are evenly distributed in the outer wall of the hollow body 10. Each of the air slots 106 can extend from the first end 102 or from a position near the first end 102 towards the second end 104. Each of the air slots 106 can be inclined to a lengthwise direction of the hollow body 10, and can be generally in the form of part of a helix that winds around the outer wall of the hollow body 10. A breadth of each of the air slots 106 is preferably $1/15 \sim 1/30$ of that of the hollow body 10, and a depth of each of the air slots 106 is $1/5 \sim 1/3$ of the wall thickness of the hollow body 10.

The suction device 11 can be a vacuum pump. The suction device 11 pumps out a certain volume of air from the inside of the hollow body 10 (i.e., depressurizes the inside of the hollow body 10) thereby providing a suction force for the hollow body 10, such that the hollow body 10 can pick the workpiece at the first end 102. When the first end 102 moves in the container, the suction device 11 introduces a certain volume of air to the inside of the hollow body 10 (i.e., partially repressurizes the inside of the hollow body 10), such that the first end 102 can place the workpiece in the container.

Figure 4:
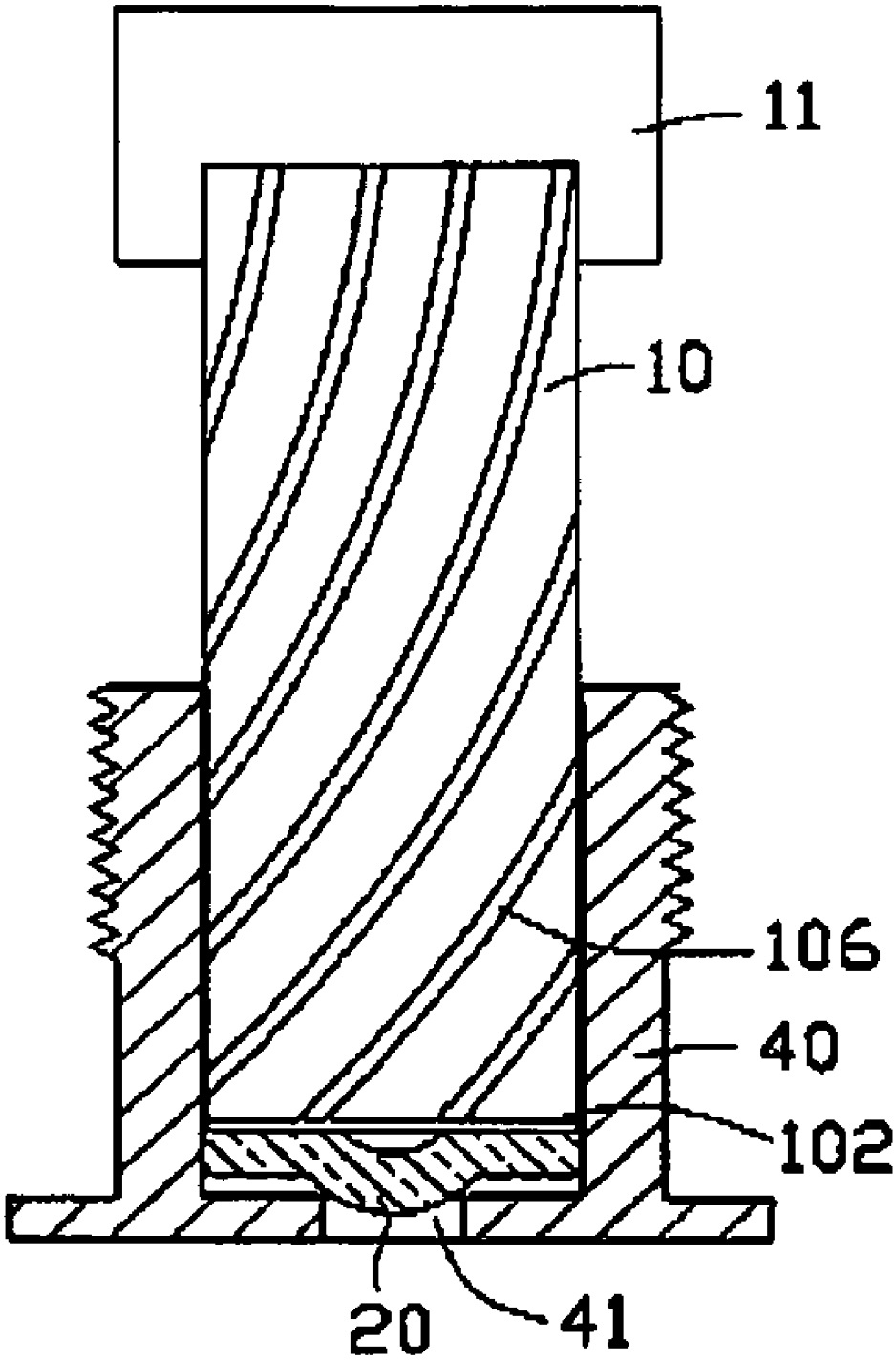
FIG. 4 and FIG. 5 are schematic views of application of the apparatus shown in FIG. 1 according to a preferred embodiment.
Figure 5:
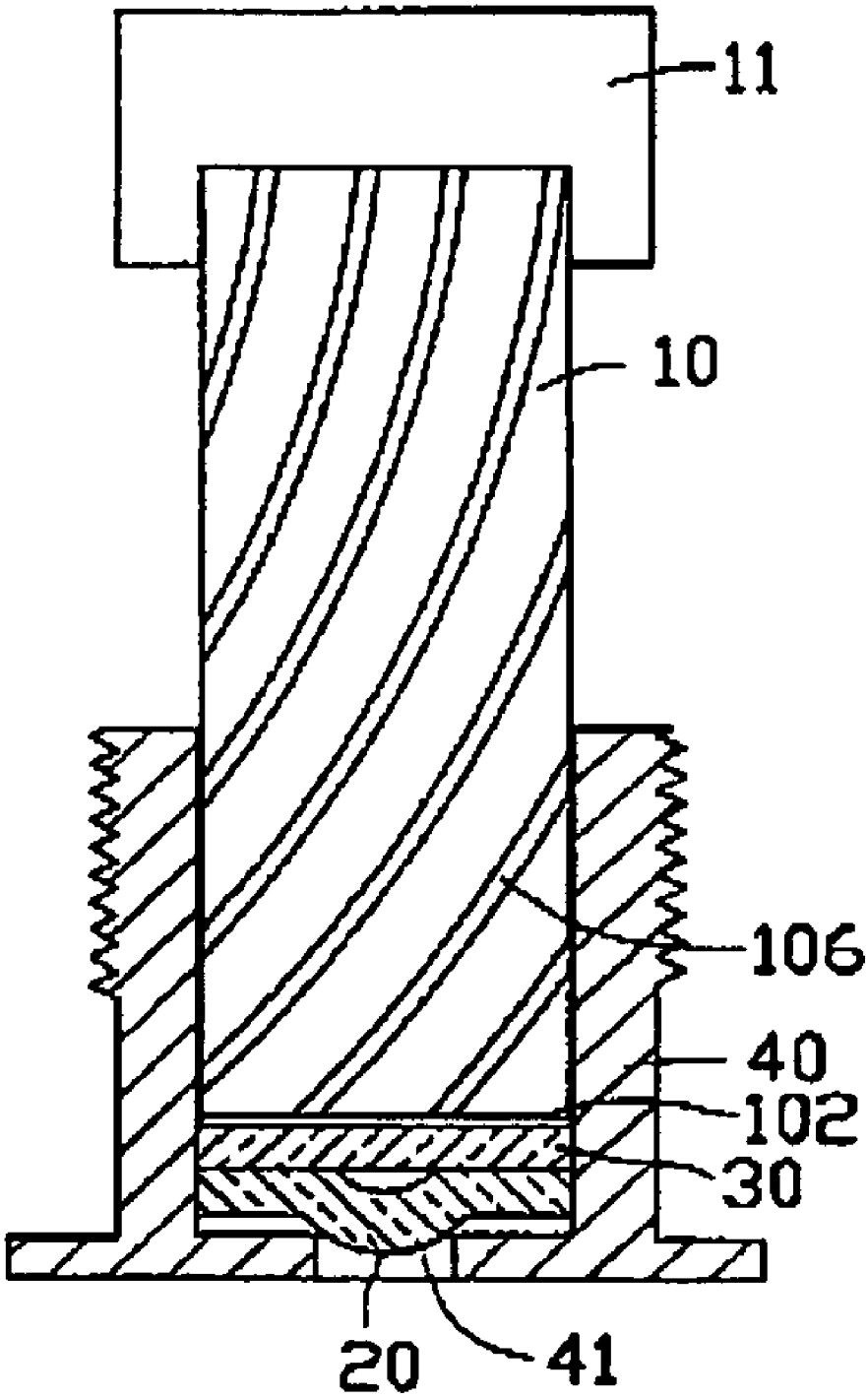

Referring to FIG. 4 and FIG. 5, the apparatus 100 is used for assembling a first workpiece 20 and a second workpiece 30 of a lens module into a container 40 according to a preferred embodiment. The apparatus 100 can be integrally formed with an apparatus for assembling lens modules, which may have other members, for example, trays for carrying the workpieces 20, 30 and the containers 40, belts for conveying the trays, motors for driving the apparatus 100 and so on. In the present preferred embodiment, the hollow body 10 is an isometric pipe, an internal diameter of the hollow body 10 is equal to or slightly smaller than an external size of the workpiece 20, 30, and an external diameter of the hollow body 10 is approximately equal to an internal diameter of the container 40. The container 40 is a barrel having a bottom opening 41.

Firstly, the hollow body 10 picks the first workpiece 20 at the first end 102 under the suction force provided by the suction device 11, moves to a bottom position of the container 40 (air inside the container 40 can escape through the bottom opening 41 thereof or through the air slots 106), and places the workpiece 20 in the bottom position. Then the hollow body 10 moves back, and at the same time air outside the container 40 enters the container 40 through the air slots 106 thereby balancing atmospheric pressure between an interior of the container 40 and an exterior of the container 40. This facilitates the hollow body 10 to easily move out of the container 40 and the workpiece 20 to be steadily received in the container 40.

Secondly, the hollow body 10 picks the second workpiece 30 at the first end 102 under the suction force provided by the suction device 11, moves in the container 40, and places the workpiece 30 in position. Then the hollow body 10 moves back.

It is understood that the apparatus 100 is not limited to assembling lens modules, and can be applied in other apparatuses for precisely and steadily placing a small and light workpiece into a container.

Figure 2:
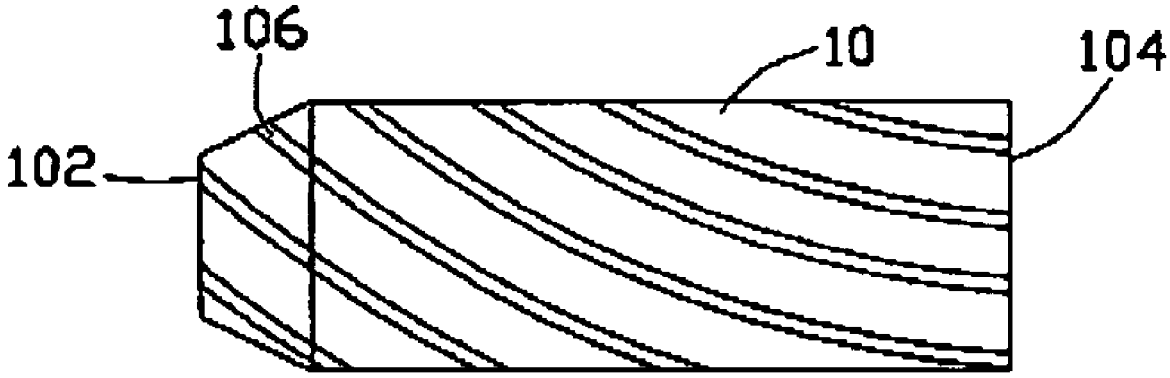
FIG. 2 is a second schematic view of a hollow body of the device shown in FIG. 1.
Figure 3:
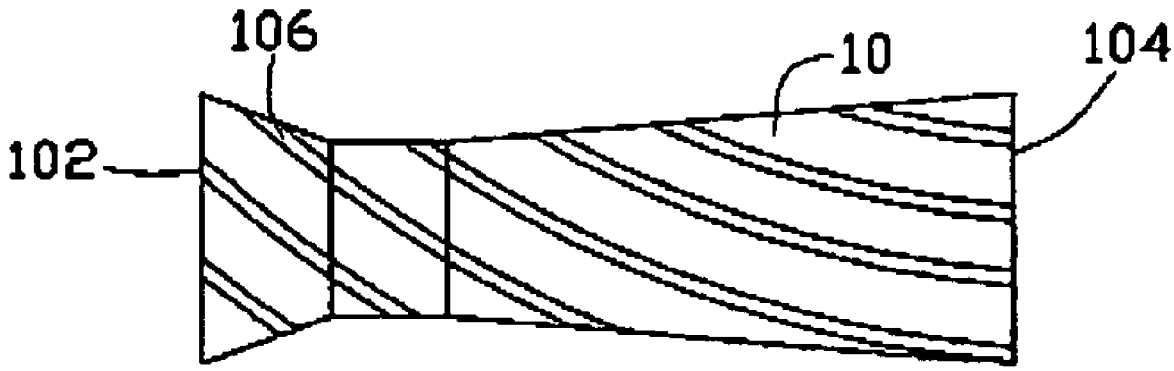
FIG. 3 is a third schematic view of a hollow body of the device shown in FIG. 1.
Figure 6:
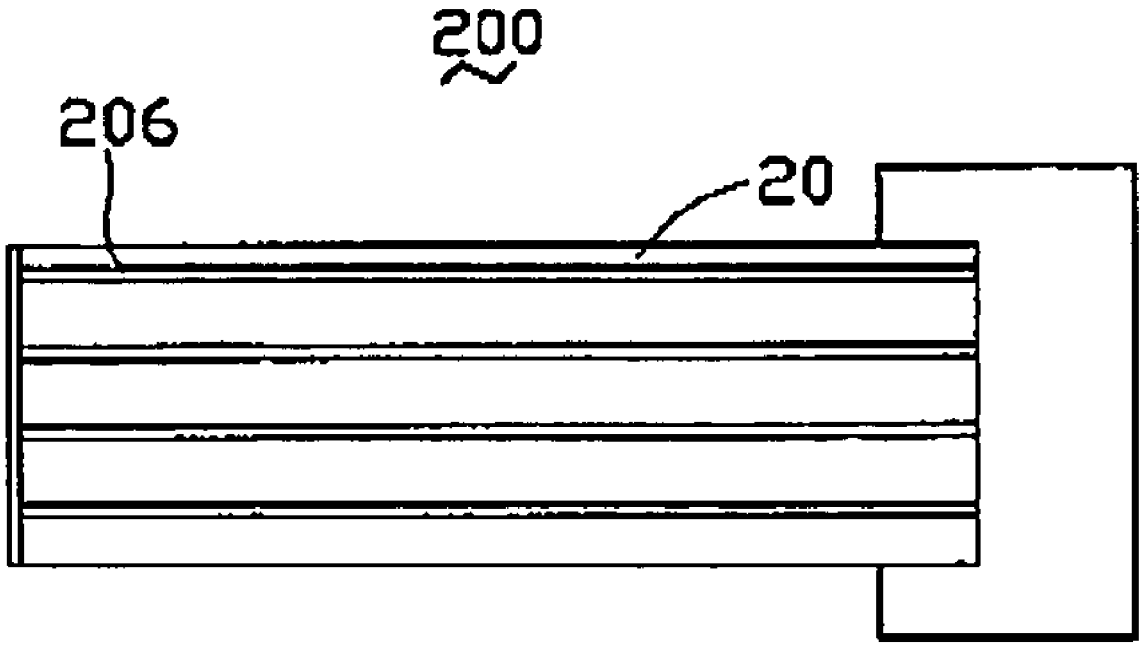
FIGS. 6-8 are schematic views of an apparatus according to another preferred embodiment.
Figure 7:
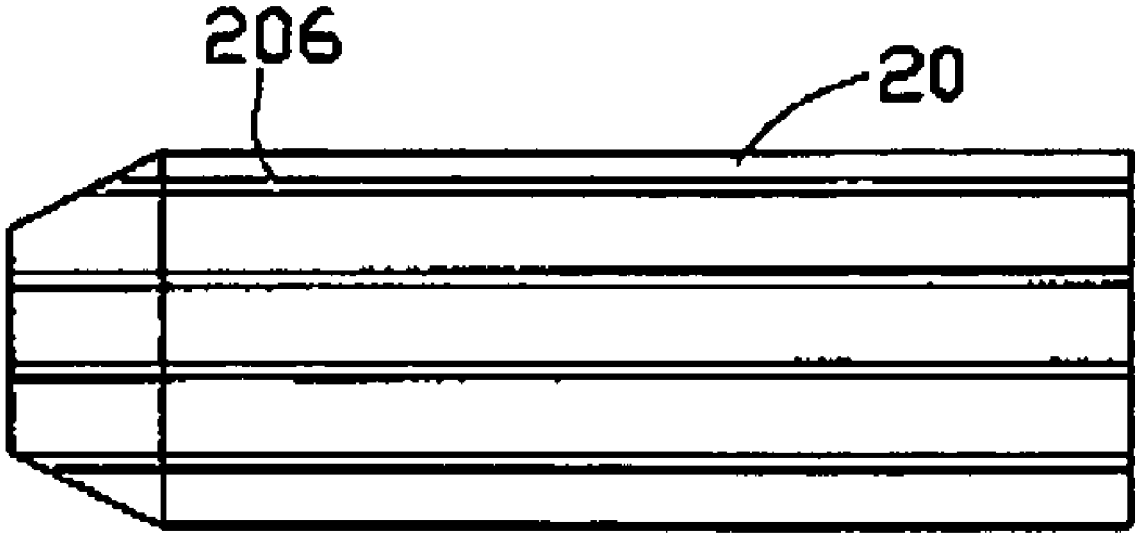
Figure 8:
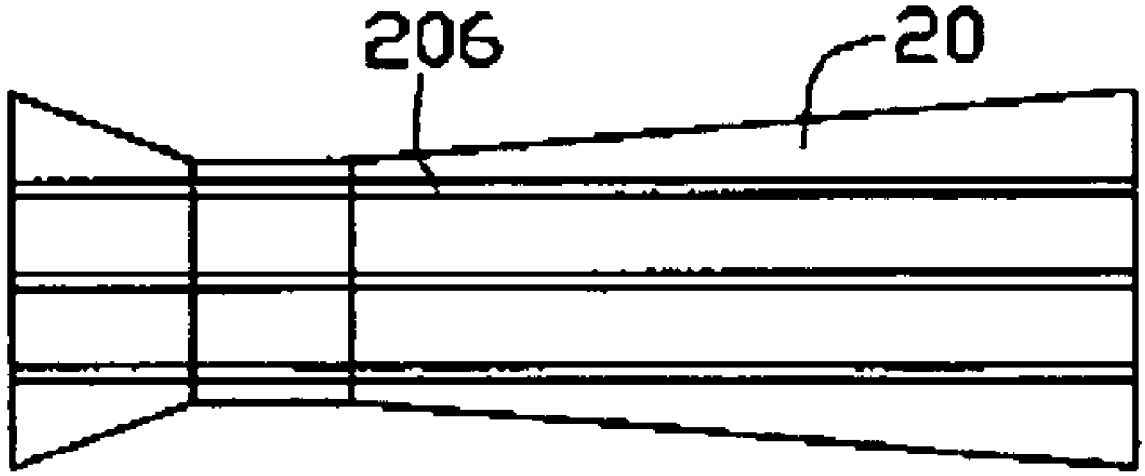

Referring to FIGS. 6-8, an apparatus 200 according to another preferred embodiment is similar to the apparatus 100 of FIGS. 1-3, except that air slots 206 are substantially parallel to a lengthwise direction of a hollow body 20. The hollow body 20 may be an isometric cylinder (see FIG. 6), a cylinder having a reducer (see FIG. 7), or a cylinder having a distortion (see FIG. 8).

It is understood that the above-described embodiment are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. An apparatus capable of picking and placing a workpiece into a container, comprising:

a suction device for providing a suction force for picking up the workpiece; and a hollow body coupled to the suction device, the hollow body having a picking portion for picking and placing the workpiece into the container under the suction force;

wherein a plurality of air slots is defined in an outer wall of the hollow body away from an inner wall of the hollow body, each of the air slots extending from one end of the hollow body to an opposite end of the hollow body;

wherein each of the air slots is inclined to a lengthwise direction of the hollow body and is generally in the form of part of a helix that winds around the outer wall of the hollow body.

2. The apparatus as claimed in claim 1, wherein the suction device is a vacuum pump.

3. The apparatus as claimed in claim 1, wherein the hollow body is an elongated isometric pipe.

4. The apparatus as claimed in claim 1, wherein the picking portion has a rubber ring mounted thereon, and the rubber ring is configured for contacting the workpiece.

5. The apparatus as claimed in claim 1, wherein the picking portion is at one of the ends of the hollow body.

6. The apparatus as claimed in claim 1, wherein the air slots are evenly distributed in the outer wall of the hollow body.

7. An apparatus for picking and placing a workpiece, the apparatus comprising:

a suction device; and a hollow body having a first end configured to picking the workpiece and a second end opposite to the first end and coupled to the suction device, a plurality of air slots being defined in an outer wall of the hollow body, the air slots being isolated from an interior of the hollow body, and each of the air slots spanning from the first end to the second end;

wherein each of the air slots is generally in the form of part a helix that winds around the outer wall of the hollow body.

8. The apparatus as claimed in claim 7, wherein the suction device is a vacuum pump.

9. The apparatus as claimed in claim 7, wherein the hollow body is an elongated isometric pipe.

10. The apparatus as claimed in claim 7, wherein the hollow body is a cylinder having a reducer.

11. The apparatus as claimed in claim 7, wherein the hollow body is a cylinder having a distortion.

12. The apparatus as claimed in claim 7, further comprising a rubber ring mounted on the first end.

13. The apparatus as claimed in claim 7, wherein the air slots are evenly distributed in the outer wall of the hollow body.

* * * * *